US007180499B2

(12) United States Patent
Lee et al.

(10) Patent No.: US 7,180,499 B2
(45) Date of Patent: Feb. 20, 2007

(54) DATA DRIVING APPARATUS AND METHOD FOR LIQUID CRYSTAL DISPLAY

(75) Inventors: Seok Woo Lee, Kyoungsangbuk-do (KR); Su Kyung Choi, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 445 days.

(21) Appl. No.: 10/125,542

(22) Filed: Apr. 19, 2002

(65) Prior Publication Data

US 2003/0071778 A1 Apr. 17, 2003

(30) Foreign Application Priority Data

Oct. 13, 2001 (KR) ..... P2001-63207

(51) Int. Cl.
*G09G 3/36* (2006.01)

(52) U.S. Cl. ..... 345/100; 345/211

(58) Field of Classification Search ..... 345/98, 345/99, 55–100, 204–213; *G09G 3/30, 3/32, G09G 3/36*

See application file for complete search history.

(56) References Cited

U.S. PATENT DOCUMENTS

| | | | | |
|---|---|---|---|---|
| 5,170,158 | A | 12/1992 | Shinya | |
| 6,078,318 | A | 6/2000 | Mori et al. | |
| 6,097,362 | A * | 8/2000 | Kim | 345/87 |
| 6,157,358 | A * | 12/2000 | Nakajima et al. | 345/96 |
| 6,256,005 | B1 | 7/2001 | Kim | 345/88 |
| 6,333,729 | B1 | 12/2001 | Ha | |
| 6,335,721 | B1 | 1/2002 | Jeong | |
| 6,795,051 | B2 * | 9/2004 | Ikeda | 345/100 |
| 2001/0017607 | A1 * | 8/2001 | Kwon et al. | 345/87 |

FOREIGN PATENT DOCUMENTS

| | | | |
|---|---|---|---|
| DE | 198 21 914 | | 11/1998 |
| DE | 198 25 276 | | 1/1999 |
| DE | 198 54 730 | | 9/1999 |
| DE | 100 25 252 | | 1/2001 |
| EP | 0 368 572 | | 5/1990 |
| EP | 1058232 | A2 | 12/2000 |
| EP | 1 191 513 | A2 | 3/2002 |
| JP | 03125582 | A * | 5/1991 |
| JP | 11-249624 | | 9/1999 |
| WO | WO 98/28731 | | 7/1998 |

* cited by examiner

*Primary Examiner*—Alexander Eisen
(74) *Attorney, Agent, or Firm*—Morgan, Lewis & Bockius, LLP

(57) ABSTRACT

A data driving apparatus for a liquid crystal display includes a plurality of output buffer integrated circuits for buffering a plurality of pixel signals and outputting the plurality of pixel signals to a plurality of data lines; a plurality of digital to analog converter integrated circuits, each of which are commonly connected to input terminals of at least two of the plurality of output buffer integrated circuits, for converting input pixel data to the plurality of pixel signals and selectively outputting the plurality of pixel signals to the at least two output buffer integrated circuits; and timing control means for controlling the plurality of digital to analog converter integrated circuits and making a time division of the pixel data into at least two regions to sequentially supply the pixel data to the plurality of data lines.

12 Claims, 5 Drawing Sheets

DATA DRIVING APPARATUS AND METHOD FOR LIQUID CRYSTAL DISPLAY

This application claims the benefit of Korean Patent Application No. P2001-63207, filed in Korea on Oct. 13, 2001, which is hereby incorporated by reference.

BACKGROUND OF THE INVENTION

1. Field of the Invention

This invention relates to a liquid crystal display, and more particularly to a data driving apparatus and method for a liquid crystal display wherein a digital to analog converter and an output buffer are separately integrated to dramatically reduce a loss caused by a poor tape carrier package. Also, the present invention is directed to a data driving apparatus and method for a liquid crystal display wherein a digital to analog converter is driven on a time division basis to reduce the number of integrated circuits for providing a digital to analog conversion function.

2. Discussion of the Related Art

Generally, a liquid crystal display (LCD) controls a light transmittance of a liquid crystal using an electric field to display a picture. To this end, the LCD includes a liquid crystal display panel having liquid crystal cells arranged in a matrix, and a driving circuit for driving the liquid crystal display panel.

In the liquid crystal display panel, gate lines and data lines are arranged in such a manner as to cross each other. A liquid crystal cell is positioned at each intersection of the gate lines and the data lines. The liquid crystal display panel is provided with a pixel electrode and a common electrode for applying an electric field to each of the liquid crystal cells. Each pixel electrode is connected, via source and drain electrodes of a thin film transistor as a switching device, to any one of data lines. The gate electrode of the thin film transistor is connected to any one of the gate lines allowing a pixel voltage signal to be applied to the pixel electrodes for each one line.

The driving circuit includes a gate driver for driving the gate lines, a data driver for driving the data lines, and a common voltage generator for driving the common electrode. The gate driver sequentially applies a scanning signal to the gate lines to sequentially drive the liquid crystal cells on the liquid crystal display panel one line at a time. The data driver applies a data voltage signal to each of the data lines whenever the gate signal is applied to any one of the gate lines. The common voltage generator applies a common voltage signal to the common electrode. Accordingly, the LCD controls a light transmittance by an electric field applied between the pixel electrode and the common electrode in accordance with the data voltage signal for each liquid crystal cell, to thereby display a picture. Each of the data drivers and gate drivers is formed from an integrated circuit (IC) chip. They are mounted in a tape carrier package (TCP) and connected to the liquid crystal display panel by a tape automated bonding (TAB) system mainly.

FIG. 1 schematically shows a data driving block in a conventional LCD.

Referring to FIG. 1, the data driving block includes data driving ICs 4 connected, via TCPs 6, to a liquid crystal display panel 2, and a data printed circuit board (PCB) 8 connected, via the TCPs 6, to the data driving ICs 4.

The data PCB 8 receives various control signals from a timing controller (not shown), and data signals and driving voltage signals from a power generator (not shown) to interface them to the data driving ICs 4. Each of the TCPs 6 is electrically connected to a data pad provided at the upper portion of the liquid crystal display panel 2 and an output pad provided at each data PCB 8. The data driving ICs 4 convert digital pixel data into analog pixel signals to apply them to data lines.

To this end, as shown in FIG. 2, each of the data driving ICs 4 includes a shift register part 14 for applying a sequential sampling signal. A latch part 16 sequentially latches a pixel data VD in response to the sampling signal and outputs the pixel data VD at the same time. A digital to analog converter (DAC) 18 for converts the pixel data VD from the latch part 16 into a pixel signal. An output buffer part 26 buffers the pixel signal from the DAC 18 to output it. Further, the data driving ICs 4 each include a signal controller 10 for interfacing various control signals from a timing controller (not shown) and the pixel data VD. A gamma voltage part 12 supplies positive and negative gamma voltages required in the DAC 18. Each of the data driving ICs 4 drives n data lines DLl to DLn.

The signal controller 10 controls various control signals such as, for example, SSP, SSC, SOE, REV and POL, and the pixel data VD to output them to the corresponding elements. The gamma voltage part 12 sub-divides several gamma reference voltages from a gamma reference voltage generator (not shown) for each gray level and outputs the sub-divided gamma reference voltges.

Shift registers included in the shift register part 14 sequentially shift a source start pulse SSP from the signal controller 10 in response to source sampling clock signal SSC to output the source start pulse SSP as a sampling signal.

A plurality of n latches included in the latch part 16 sequentially sample the pixel data VD from the signal controller 10 in response to the sampling signal from the shift register part 14 to latch it. Subsequently, the n latches respond to a source output enable signal SOE from the signal controller 10 to output the latched pixel data VD at the same time. In this case, the latch part 16 restores the pixel data VD modulated in such a manner to have a reduced transition bit number in response to a data inversion selecting signal REV and then outputs the pixel data VD. This is because the pixel data VD, having a transition bit number going beyond a reference value, is supplied such that it is modulated to have a reduced transition bit number in order to minimize an electromagnetic interference (EMI) upon data transmission from the timing controller.

The DAC 18 converts the pixel data VD from the latch part 16 into positive and negative pixel signals at the same time and outputs the signals. To this end, the DAC 18 includes a positive (P) decoding part 20 and a negative (N) decoding part 22, each of which are commonly connected to the latch part 16, and a multiplexor (MUX) 24 for selecting output signals of the P and N decoding parts 20 and 22.

A plurality of n P decoders, which are included in the P decoding part 20, convert n pixel data simultaneously inputted from the latch part 16 into positive pixel signals with the aid of positive gamma voltages from the gamma voltage part 12. A plurality of n N decoders, which are included in the N decoding part 22, convert n pixel data simultaneously inputted from the latch part 16 into negative pixel signals with the aid of negative gamma voltages from the gamma voltage part 12. The multiplexor 24 responds to a polarity control signal POL from the signal controller 10 to selectively output the positive pixel signals from the P decoding part 20 or the negative pixel signals from the N decoding part 22.

A plurality of n output buffers included in the output buffer part 26 consist of voltage followers which are connected to the n data lines DL1 to DLn in series. These output buffers buffer the pixel signals from the DAC 18 and apply the signals to the data lines DL1 to DLn.

As described above, each of the conventional data driving ICs 4 should have n latches and 2n decoders so as to drive n data lines DL1 to DLn. As a result, the conventional data driving IC 4 has a disadvantage in that it has a complex configuration and a relatively high manufacturing cost.

Furthermore, each of the conventional data driving ICs 4 is attached to the TCP 6 in a single chip to adhered to the liquid crystal display panel 2 and the data PCB 8 as shown in FIG. 1. Accordingly, the TCP has a high probability of, for example, breaking or short-circuiting. Thus, a large loss in costs results since the data driving ICs 4 mounted in the TCP 6 also cannot be used when the TCP 6 breaks or short-circuits.

SUMMARY OF THE INVENTION

Accordingly, the present invention is directed to a data driving apparatus and method for liquid crystal display that substantially obviate one or more of the problems due to limitations and disadvantages of the related art.

An object of the present invention is to provide a data driving apparatus and method for a liquid crystal display wherein a digital to analog converter and an output buffer are separately integrated to dramatically reduce loss caused by a poor tape carrier package.

Another object of the present invention is to provide a data driving apparatus and method for a liquid crystal display wherein a digital to analog converter is driven on a time division basis to reduce the number of integrated circuits for providing a digital to analog conversion function.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the data driving apparatus for a liquid crystal display includes: a plurality of output buffer integrated circuits for buffering a plurality of pixel signals and outputting the plurality of pixel signals to a plurality of data lines; a plurality of digital to analog converter integrated circuits, each of which are commonly connected to input terminals of at least two of the plurality of output buffer integrated circuits, for converting input pixel data to the plurality of pixel signals and selectively outputting the plurality of pixel signals to the at least two output buffer integrated circuits; and timing control means for controlling the plurality of digital to analog converter integrated circuits and making a time division of the pixel data into at least two regions to sequentially supply the pixel data to the plurality of data lines.

A data driving apparatus for a liquid crystal display according to another aspect of the present invention includes: a plurality of output buffer integrated circuits for buffering a plurality of pixel signals and outputting the plurality of pixel signals to a plurality of data lines; and a plurality of digital to analog converter integrated circuits, each of which are commonly connected to input terminals of at least two of the plurality of output buffer integrated circuits, for converting input pixel data to the plurality of pixel signals and outputting the plurality of pixel signals to the at least two output buffer integrated circuits in a time division of the pixel signals.

In another aspect, a method of driving a data driving apparatus for driving a plurality of data lines arranged at a liquid crystal display panel, wherein the driving apparatus includes a plurality of output buffer integrated circuits connected to the plurality of data lines, and a plurality of digital to analog converter integrated circuits commonly connected to input terminals of at least two of the plurality of output buffer integrated circuits, includes: making a time division of pixel data to be supplied to each of the plurality of digital to analog converter integrated circuits into at least two regions; converting the pixel data into analog pixel signals; and selectively applying the converted pixel signals to the at least two output buffer integrated circuits and to the plurality of data lines.

A method of driving a data driving apparatus for a liquid crystal display panel display according to another aspect of the present invention includes: converting at least two pixel data into analog pixel data, and outputting the converted pixel signals to at least two output buffer integrated circuits in a time division of the pixel signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 3:
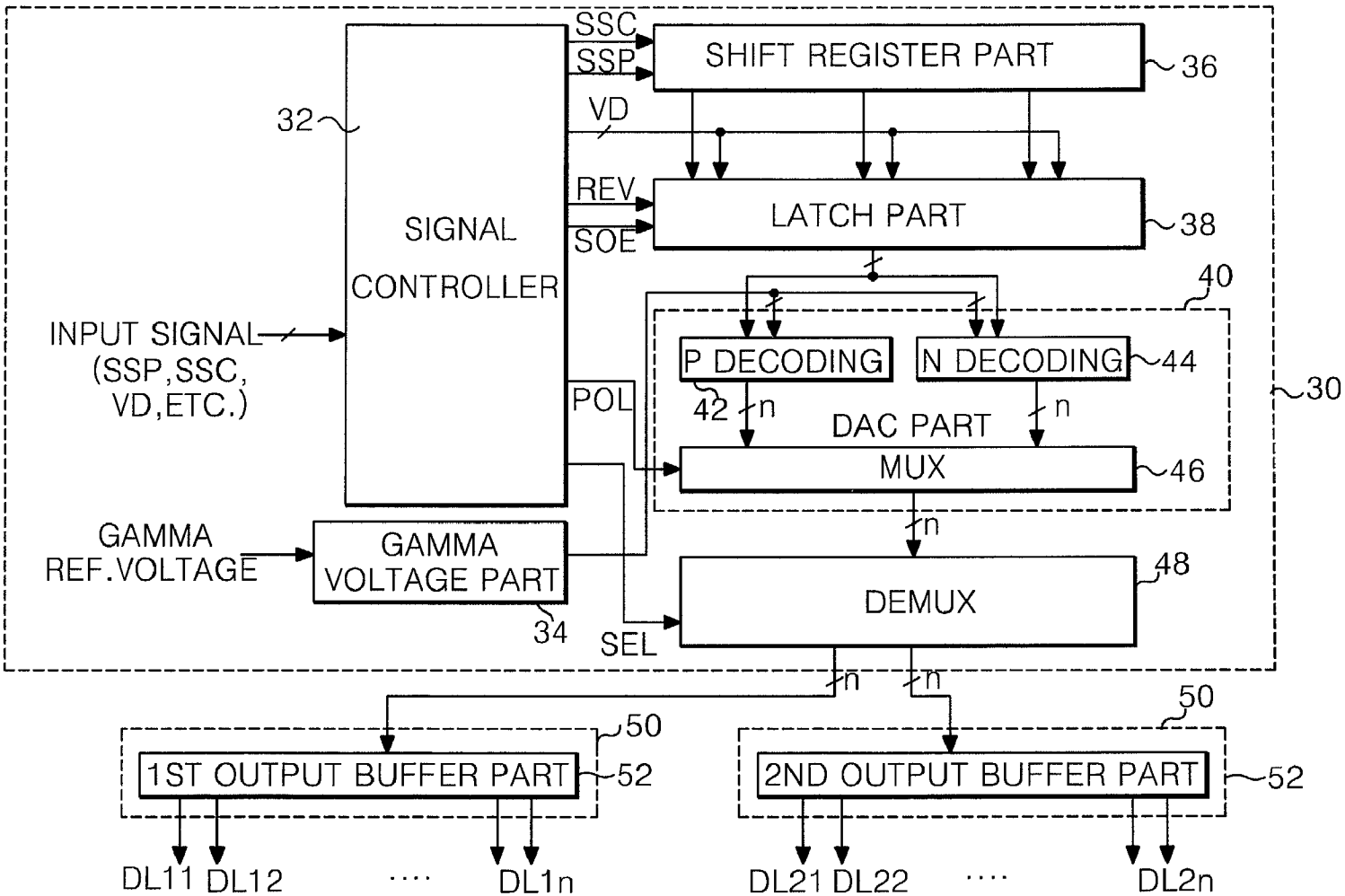
FIG. 3 is a block diagram showing a configuration of a data driver in a liquid crystal display according to an embodiment of the present invention.

FIG. 3 is a block diagram showing a configuration of a data driving apparatus for a liquid crystal display according to an embodiment of the present invention.

Referring to FIG. 3, the data driving apparatus is largely divided into DAC means having a digital to analog conversion function and buffer means having an output buffering function, which are integrated into a separated chip. In other words, the data driving apparatus has a DAC IC 30 and at least two output buffer ICs 50 configured separately. Particularly, the DAC IC 30 is divided into at least two regions on a time basis such that the at least two output buffer ICs 50 are commonly connected to a single DAC IC 30 for driving, to thereby provide a DAC function.

Hereinafter, a case where two output buffer ICs 50 are commonly connected to a single DAC IC 30 will be described as an example.

The DAC IC 30 includes a shift register part 36 for applying a sequential sampling signal. A latch part 38 sequentially latches a pixel data VD in response to the sampling signal and outputs the pixel data VD at the same time. A digital to analog converter (DAC) 40 converts the pixel data VD from the latch part 38 into a pixel signal. A demultiplexor 48 sequentially applies the pixel signal from the DAC 40 to the two output buffer ICs 50. Furthermore, the DAC IC 30 includes a signal controller 32 for interfacing various control signals from a timing controller (not shown) and the pixel data VD. A gamma voltage part 34 supplies positive and negative gamma voltages required in the DAC 40. Each DAC IC 30 is driven on a time division basis to sequentially output pixel signals to be applied to 2n data lines DL1l to DL1n and DL2l to DL2n n by n.

In order to permit the DAC IC 30 to drive twice the number of data lines as compared to the number of data lines in the conventional data driving IC, driving signals have frequencies that are twice those of the conventional data driving IC.

The signal controller 32 controls various control signals such as, for example, SSP, SSC, SOE, REV, and POL, from a timing controller and the pixel data VD to output them to the corresponding elements. In this case, the timing controller allows the various control signals and the pixel data VD to have a frequency twice that of the prior art. Particularly, the timing controller makes a time division of 2n pixel data VD corresponding to the 2n data lines DL1l to DL1n and DL2l to DL2n into two regions to sequentially supply them n by n.

The gamma voltage part 34 sub-divides a plurality of gamma reference voltages from a gamma reference voltage generator (not shown) for each gray level and outputs the sub-divided gamma reference voltages.

Shift registers included in the shift register part 36 sequentially shift a source start pulse SSP from the signal controller 32 in response to a source sampling clock signal SSC to output the source start pulse SSP as a sampling signal. In this case, the shift register part 36 responds to the source start pulse SSP and the source sampling clock signal SSC each having a frequency doubled to output a sampling signal at twice the speed in comparison to the prior art.

A plurality of n latches included in the latch part 38 sequentially sample the pixel data VD from the signal controller 32 in response to the sampling signal from the shift register part 36 to latch it. Subsequently, the n latches respond to a source output enable signal SOE from the signal controller 32 to output the latched pixel data VD at the same time. In this case, the latches restore the pixel data VD modulated in such a manner as to have a reduced transition bit number in response to a data inversion selecting signal REV and then output the pixel data VD. This is because the pixel data VD, having a transition bit number going beyond a reference value, is supplied such that it is modulated to have a reduced transition bit number in order to minimize an electromagnetic interference (EMI) upon data transmission from the timing controller.

Figure 1:
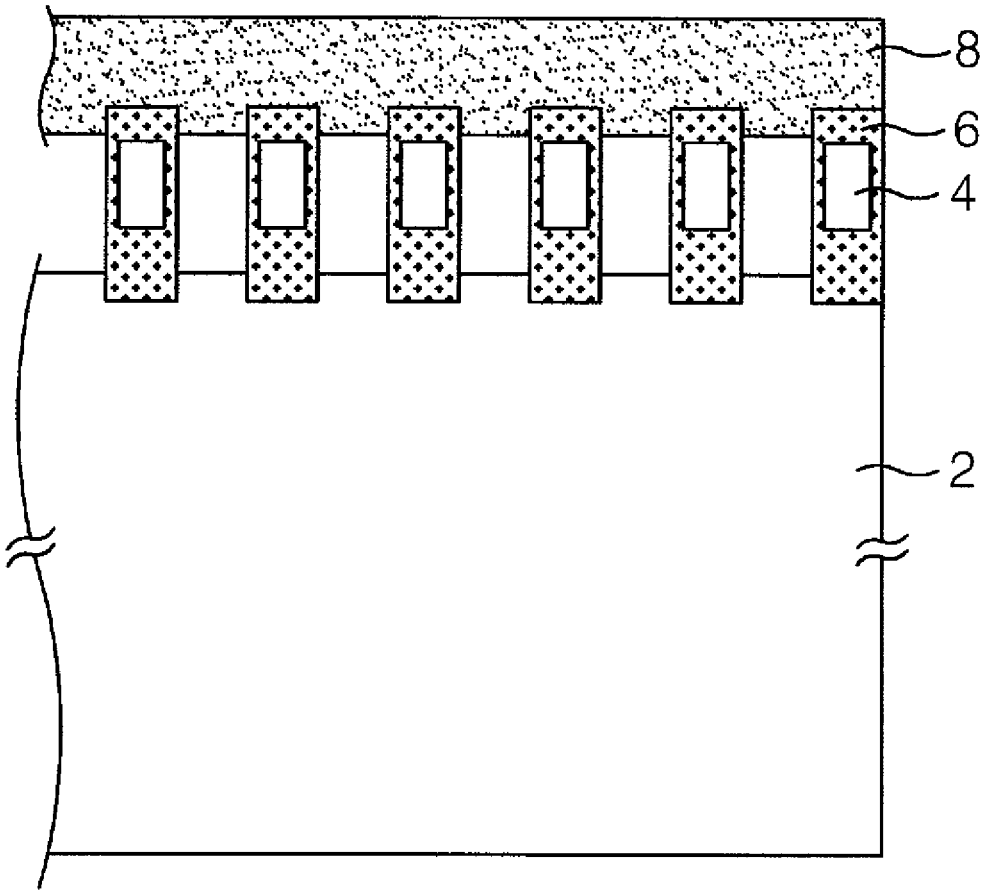
FIG. 1 CONVENTIONAL ART
FIG. 1 is a schematic view showing a data driving block in a conventional liquid crystal display.
Figure 2:
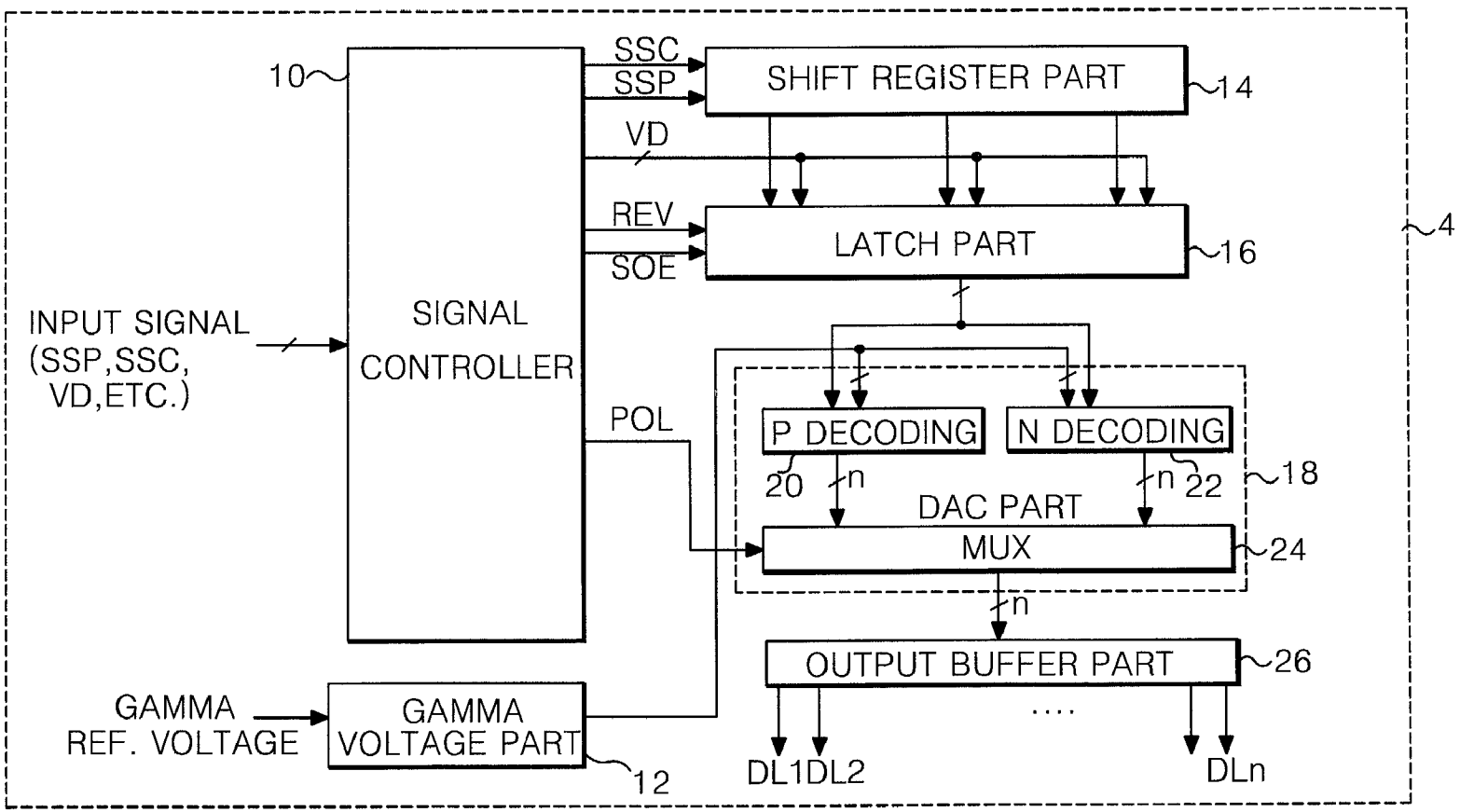
FIG.2 CONVENTIONAL ART
FIG. 2 is a block diagram showing a configuration of the data driving integrated circuit in FIG. 1.
Figure 4A:
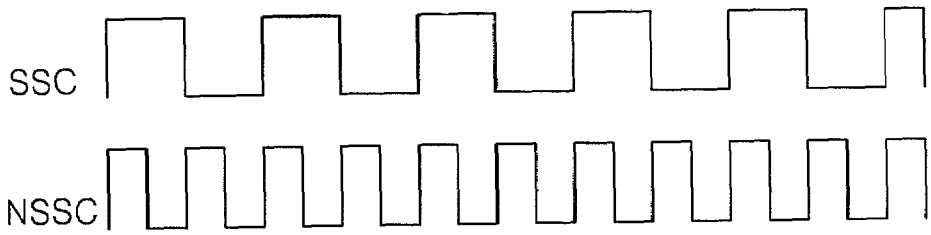
FIG. 4A and FIG. 4B are comparative waveform diagrams of driving signals of the latch part shown in FIG. 2 and the latch part shown in FIG. 3.
Figure 4B:
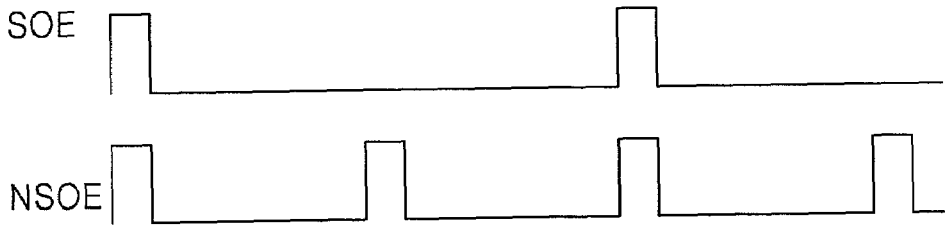

Herein, the source sampling clock signal SSC and the source output enable signal SOE applied to the shift register part 36 and the latch part 38 have twice frequency of the "SSC" and "SOE" applied to the conventional shift register part 14 and latch part 16 shown in FIG. 2, as indicated by "NSSC" and "NSOE" in FIG. 4A and FIG. 4B, respectively.

The DAC 40 converts the pixel data VD from the latch part 38 into positive and negative pixel signals at the same time and outputs the signals. To this end, the DAC 40 includes a positive (P) decoding part 42 and a negative (N) decoding part 44, each of which are commonly connected to the latch part 38, and a multiplexor (MUX) 46 for selecting output signals of the P and N decoding parts 42 and 44.

A plurality of n P decoders, which are included in the P decoding part 42, convert n pixel data simultaneously inputted from the latch part 38 into positive pixel signals with the aid of positive gamma voltages from the gamma voltage part 34. A plurality of n N decoders, which are included in the N decoding part 44, convert n pixel data simultaneously inputted from the latch part 38 into negative pixel signals with the aid of negative gamma voltages from the gamma voltage part 34. The multiplexor 46 responds to a polarity control signal POL from the signal controller 32 to selectively output the positive pixel signals from the P decoding part 42 or the negative pixel signals from the N decoding part 44. The DAC 40 converts the pixel data into pixel signals n by n at a speed twice that of the conventional DAC 18, to thereby convert the 2n pixel data into pixel signals.

Figure 4C:
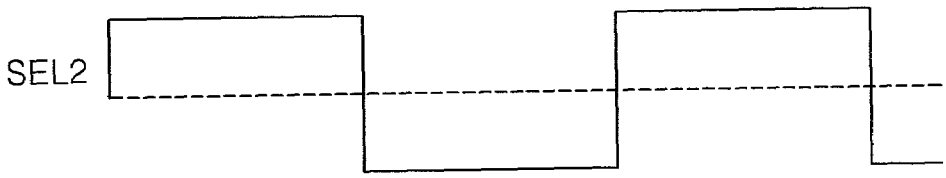
FIG. 4C is a waveform diagram of a driving signal of the demultiplexor shown in FIG. 3.

The demultiplexor 48 outputs n pixel signals from the multiplexor 46 to the first output buffer IC 50 or the second output buffer IC 50 in response to a selection control signal SEL inputted from the signal controller 32 as shown in FIG. 4C. The selection control signal SEL has an inverted logical value every period of the source output enable signal SOE applied to the latch part 38, thereby allowing each of the n pixel signals to sequentially be output to the first output buffer IC 50 and the second output buffer IC 50.

Each of the first and second output buffer ICs 50 includes an output buffer part 52 for buffering pixel signals from the DAC IC 30 to output them to the n data lines DL1l to DL1n or DL2l to DL2n. n output buffers included in each output buffer part 52 consist of voltage followers which are connected to the n data lines DL1l to DL1n or DL2l to DL2n in series. These output buffers make a buffering of the pixel signals from the DAC 18 and apply them to the data lines DL1l to DL1n or DL2l to DL2n.

Figure 5:
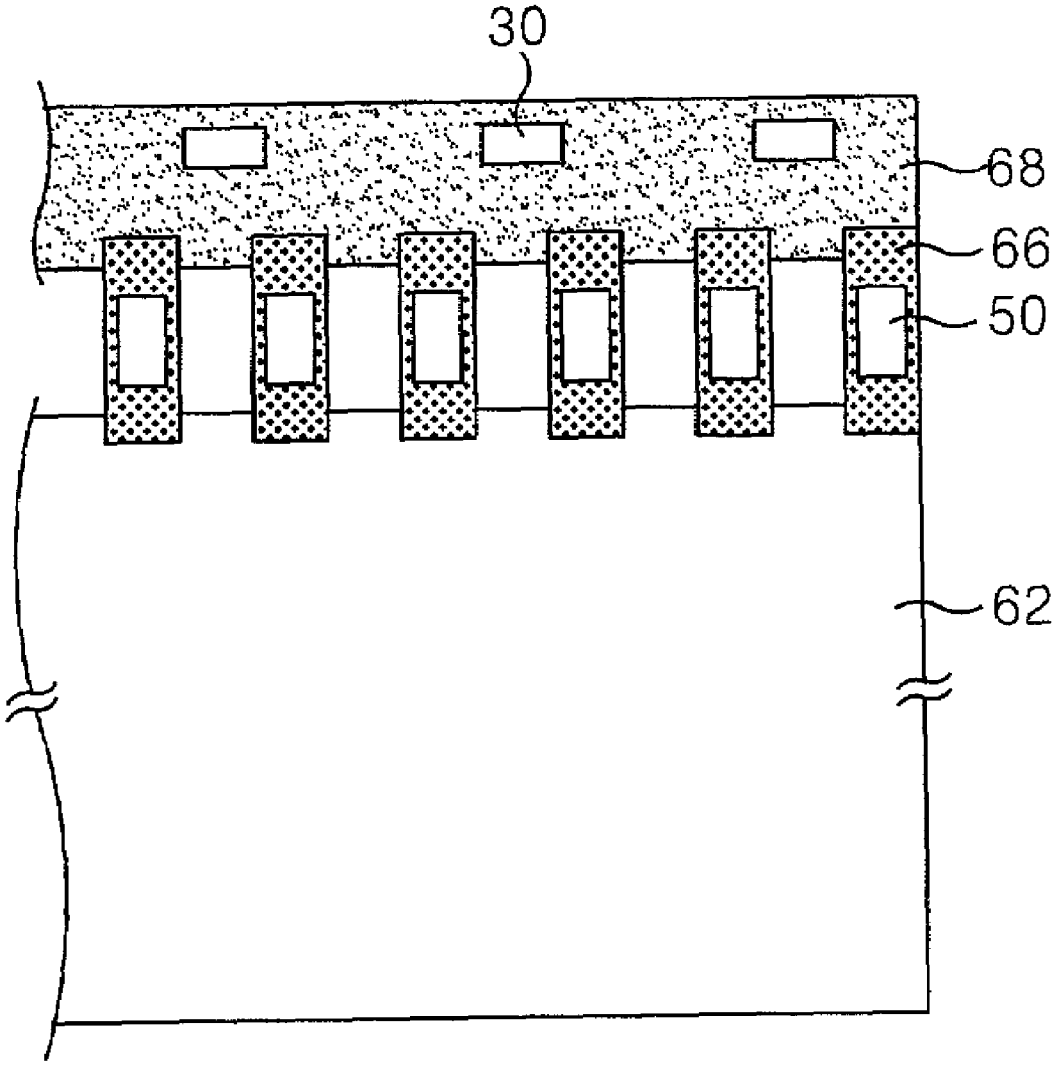
FIG. 5 is a schematic view showing a data driving block in the liquid crystal display including the data driver shown in FIG. 3.

As shown in FIG. 5, the DAC ICs 30 are mounted in a data PCB 68 while the output buffer ICs 50 are mounted in a TCP 66. The data PCB 68 sends various control signals from a timing controller (not shown) and data signals to the DAC ICs 30, and sends pixel signals from the DAC ICs 30 to the output buffer ICs 50 via the TCP 66. The TCP 66 is electrically connected to data pads provided at the upper portion of a liquid crystal display panel 62 and output pads provided at the PCB 68. As described above, the simply configured output buffer ICs 50, having only a buffering function, are mounted in the TCP 66, so that only the output buffer ICs 50 are damaged when the TCP 66 is damaged. As a result, the large loss in costs resulting from an inability to use the expensive data driving ICs caused by a damaged TCP 66 in the prior art can be reduced dramatically. Furthermore, the DAC IC 30 is divided on a time basis to sequentially apply the pixel signals to at least two output buffer ICs 50 n by n. Accordingly, the number of DAC ICs 30 is reduced to ½ in comparison to prior art arrangements, so that it becomes possible to reduce the manufacturing cost.

As described above, according to the present invention, the DAC means and the output buffering means are integrated into a separate chip to thereby mount only the simply configured output buffer ICs in the TCP having a high probability of breaking or short-circuiting. Accordingly, it is possible to dramatically reduce loss resulted from the inability to use the expensive data driver ICs due to a damaged TCP in prior art arrangements.

Moreover, according to the present invention, the DAC IC is driven on a time division basis with the aid of driving signals having higher frequencies to thereby commonly connect a single DAC IC to at least two output buffer ICs, so that it becomes possible to reduce the number of DAC ICs and thus the manufacturing cost.

It will be apparent to those skilled in the art that various modifications and variations can be made in the data driving apparatus and method for liquid crystal display of the present invention without departing from the spirit or scope of the invention. Thus, it is intended that the present invention cover the modifications and variations of this invention provided they come within the scope of the appended claims and their equivalents.

What is claimed is:

1. A data driving apparatus for a liquid crystal display, comprising:

a plurality of output buffer integrated circuits, each of the output buffer integrated circuits simultaneously buffering a plurality of pixel signals and outputting the plurality of pixel signals to a plurality of data lines;

a plurality of digital to analog converter integrated circuits, each of which are connected to input terminals of at least two of the plurality of output buffer integrated circuits, converting input pixel data into the plurality of pixel signals and selectively outputting the plurality of pixel signals to one of the at least two output buffer integrated circuits; and timing control means for controlling the plurality of digital to analog converter integrated circuits and making a time division of the input pixel data into at least two regions to sequentially supply the pixel data to the plurality of data lines.

2. The data driving apparatus according to claim 1, wherein the plurality of digital to analog converter integrated circuits are mounted in a printed circuit board connected to the timing control means, and each of the plurality of output buffer integrated circuits is mounted in a tape carrier package electrically connected between the printed circuit board and a liquid crystal display panel at which the plurality of data lines are arranged.

3. The data driving apparatus according to claim 1, wherein each of the plurality of digital to analog converter integrated circuits includes:

shift register means for sequentially outputting a sampling signal under control of the timing control means;

latch means for responding to the control of the timing control means and the sampling signal to sequentially latch pixel data inputted from the timing control means and to output the latched pixel data at the same time;

digital to analog converting means for converting the pixel data into positive and negative pixel signals using input gamma voltages to output the pixel signals responding to a polarity control signal from the timing control means; and a demultiplexor for responding to a selection control signal from the timing control means to selectively output the pixel signals from the digital to analog converting means to the at least two output buffer integrated circuits.

4. The data driving apparatus according to claim 3, wherein each of the plurality of digital to analog converter integrated circuits further includes:

a signal controller for interfacing various control signals from the timing control means and the pixel data to apply the control signals to the shift register means, the latch means, the digital to analog converting means and the demultiplexor; and gamma voltage means for sub-dividing an input gamma reference voltage to generate gamma voltages.

5. The data driving apparatus according to claim 3, wherein the timing control means inverts a logical state of the selection control signal every period of an output enable signal controlling an output of the latching means, thereby allowing the pixel signals to be sequentially applied to the at least two output buffer integrated circuits.

6. The data driving apparatus according to claim 1, wherein each of the output buffer integrated circuits outputs the pixel signals to n data lines, n being a positive integer greater than one, and each of the digital to analog converter integrated circuits converts the pixel data into the pixel signals n-by-n and outputs the converted pixel signals to one of the at least two output buffer integrated circuits n-by-n.

7. A data driving apparatus for a liquid crystal display, comprising:

a plurality of output buffer integrated circuits, each output buffer integrated circuit simultaneously buffering a plurality of pixel signals and outputting the plurality of pixel signals to a plurality of data lines; and a plurality of digital to analog converter integrated circuits, each of which are connected to input terminals of at least two of the plurality of output buffer integrated circuits, converting input pixel data into the plurality of pixel signals and outputting the plurality of pixel signals to one of the at least two output buffer integrated circuits based on a time division of the pixel signals, such that the buffered pixel signals from each of the output buffer integrated circuits are applied sequentially to the plurality of data lines.

8. The data driving apparatus according to claim 7, further comprising timing control means for controlling the plurality of digital to analog converter integrated circuits and making the time division of the input pixel data into at least two regions to sequentially supply the pixel data to the plurality of data lines.

9. The data driving apparatus according to claim 7, wherein each of the output buffer integrated circuits outputs the pixel signals to n data lines, n being a positive integer greater than one, and each of the digital to analog converter integrated circuits converts the pixel data into the pixel signals n-by-n and outputs the converted pixel signals to one of the at least two output buffer integrated circuits n-by-n.

10. A method of driving a data driving apparatus for driving a plurality of data lines arranged at a liquid crystal display panel wherein the driving apparatus includes a plurality of output buffer integrated circuits, each of the output buffer integrated circuits connected to more than one of the plurality of data lines, and a plurality of digital to analog converter integrated circuits commonly connected to input terminals of at least two of the plurality of output buffer integrated circuits, the method comprising:

making a time division of pixel data to be supplied to each of the plurality of digital to analog converter integrated circuits into at least two regions;

converting the pixel data into analog pixel signals;

selectively applying the converted pixel signals to one of the at least two output buffer integrated circuits based on the time division of the pixel data; and applying the buffered pixel signals from each of the output buffer integrated circuits sequentially to the plurality of data lines.

11. The method according to claim 10, wherein the step of converting the pixel data into the pixel signals includes:

generating a sequential sampling signal;

responding to the sampling signal to sequentially sample and latch the pixel data; converting the pixel data into a plurality of positive and negative pixel signals using gamma voltages; and selecting any one of the plurality of positive and negative pixel signals to output the pixel signals.

12. The method according to claim 10, wherein each of the output buffer integrated circuits connects to n data lines, n being a positive integer greater than one, the pixel data are converted into the pixel signals n-by-n, the converted pixel signals are outputted to one of the at least two output buffer integrated circuits n-by-n, and the buffered pixel signals are outputted to the data lines sequentially from one of the at least two output buffer integrated circuits n-by-n.

* * * * *